US008667960B2

(12) United States Patent
Ausen

(10) Patent No.: US 8,667,960 B2
(45) Date of Patent: Mar. 11, 2014

(54) RADIAL BLOWER WITH SHAPED SCROLL PROFILE

(75) Inventor: David L. Ausen, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 254 days.

(21) Appl. No.: 13/080,772

(22) Filed: Apr. 6, 2011

(65) Prior Publication Data

US 2011/0240026 A1 Oct. 6, 2011

Related U.S. Application Data

(60) Provisional application No. 61/321,248, filed on Apr. 6, 2010.

(51) Int. Cl.
*A62B 7/10* (2006.01)

(52) U.S. Cl.
USPC ..... 128/201.25; 128/200.24; 2/171.3; 2/410; 2/424

(58) Field of Classification Search
USPC ..... 128/200.24, 201.22–202.12, 202.19, 128/204.18, 204.21, 205.26; 415/206, 415/219.1, 224; 600/21–22; 2/171.3, 410, 2/424
See application file for complete search history.

(56) References Cited

U.S. PATENT DOCUMENTS

| | | | | |
|---|---|---|---|---|
| 909,863 | A * | 1/1909 | Bowie, Jr. | 415/204 |
| 3,098,603 | A * | 7/1963 | Baker | 415/204 |
| 3,822,698 | A | 7/1974 | Guy | |
| 4,133,308 | A * | 1/1979 | Lowe et al. | 128/201.25 |
| 4,136,688 | A * | 1/1979 | Gorman | 55/385.1 |
| 4,280,491 | A * | 7/1981 | Berg et al. | 128/201.24 |
| 4,730,612 | A * | 3/1988 | Dampney | 128/201.24 |
| 5,125,402 | A | 6/1992 | Greenough | |
| 5,283,914 | A * | 2/1994 | James | 2/424 |
| 5,352,089 | A | 10/1994 | Tokunaga et al. | |
| 5,533,500 | A * | 7/1996 | Her-Mou | 128/201.25 |
| 5,711,033 | A * | 1/1998 | Green et al. | 2/171.3 |
| 5,887,281 | A * | 3/1999 | Green et al. | 2/171.3 |
| 6,224,335 | B1 * | 5/2001 | Parisi et al. | 415/206 |

(Continued)

FOREIGN PATENT DOCUMENTS

| | | |
|---|---|---|
| EP | 1582750 A2 | 6/2009 |
| JP | 2001/221197 A | 8/2001 |

(Continued)

OTHER PUBLICATIONS

International Search Report for PCT/US2011/031334, dated Jul. 14, 2011, prepared by the European Patent Office.

*Primary Examiner* — Loan Thanh
*Assistant Examiner* — Andrew S Lo
(74) *Attorney, Agent, or Firm* — Kenneth B. Wood

(57) ABSTRACT

A powered air purifying respirator (PAPR) includes a radial blower. The radial blower includes at least an impeller and a scroll having an upper outer surface and a lower outer surface. In one embodiment, a cross section of an air passageway of the scroll includes sides corresponding to the upper outer surface and the lower outer surface, the sides having parallel slanted segments. In another embodiment, the sides may be substantially parallel and may be curved. In yet another embodiment an upper outer surface of the scroll is concave and a lower outer surface of the scroll is convex. In that embodiment, the PAPR further includes an inlet, and the inlet is disposed at the lower outer surface.

15 Claims, 4 Drawing Sheets

(56) References Cited

U.S. PATENT DOCUMENTS

| | | | | |
|---|---|---|---|---|
| 6,254,336 | B1 * | 7/2001 | Ahn | 415/119 |
| 6,481,019 | B2 | 11/2002 | Diaz et al. | |
| 7,014,422 | B2 * | 3/2006 | Hancock | 415/204 |
| 2001/0032348 | A1 * | 10/2001 | Diaz et al. | 2/171.3 |
| 2001/0037519 | A1 | 11/2001 | Paris et al. | |
| 2003/0066121 | A1 * | 4/2003 | Diaz et al. | 2/171.3 |
| 2003/0101505 | A1 | 6/2003 | Paris et al. | |
| 2005/0071909 | A1 * | 4/2005 | Diaz et al. | 2/171.3 |
| 2005/0108807 | A1 * | 5/2005 | Ahn et al. | 2/171.3 |
| 2006/0076012 | A1 | 4/2006 | Tanizawa et al. | |
| 2006/0101556 | A1 * | 5/2006 | Goldsborough | 2/171.3 |
| 2006/0204382 | A1 | 9/2006 | Tungl et al. | |
| 2006/0213523 | A1 | 9/2006 | VanDerWoude et al. | |
| 2006/0239815 | A1 * | 10/2006 | Hanai | 415/206 |
| 2007/0003414 | A1 * | 1/2007 | Harman | 415/206 |
| 2007/0044800 | A1 | 3/2007 | Church et al. | |
| 2007/0089221 | A1 * | 4/2007 | Manzella et al. | 2/456 |
| 2007/0277294 | A1 * | 12/2007 | Green | 2/410 |
| 2008/0112127 | A1 | 5/2008 | June et al. | |
| 2008/0141442 | A1 * | 6/2008 | Chen | 2/411 |
| 2009/0210989 | A1 * | 8/2009 | Becker et al. | 2/8.6 |
| 2009/0266361 | A1 | 10/2009 | Bilger et al. | |
| 2010/0226766 | A1 * | 9/2010 | Eguchi et al. | 415/206 |

FOREIGN PATENT DOCUMENTS

| | | | |
|---|---|---|---|
| WO | WO 2008/065932 | A1 | 6/2008 |
| WO | WO 2008/068959 | A1 | 6/2008 |
| WO | WO 2009/067583 | | 5/2009 |

* cited by examiner

RADIAL BLOWER WITH SHAPED SCROLL PROFILE

CROSS-REFERENCE TO RELATED APPLICATION

This application claims priority to U.S. Provisional Patent Application No. 61/321,248, filed Apr. 6, 2010, the disclosure of which is incorporated by reference herein in its entirety.

FIELD OF THE INVENTION

The present disclosure pertains to radial blowers including radial blowers used in helmet-mounted respirator systems.

BACKGROUND

Radial blowers are used in a wide variety of applications including industrial, electronic and personal uses. For example, cooling devices such as fans for cooling electronic components or providing air conditioning, and other positive air pressure devices, such as filtration devices, frequently include radial blowers. Such blowers typically have a central inlet and an impeller that draws air through the inlet as it is rotated by a motor and forces the air in a circular direction. A scroll often provides a housing for the blower components and includes an air passageway that wraps around the circumference of the impeller. The impeller can force air through the air passageway and out an outlet.

Many factors influence flow velocity and pressure and the efficiency of a radial blower. For example, fluid density, motor speed and power, impeller design and size, and the shape and size of the scroll all impact the efficiency and output of a radial blower. In some industrial applications design of a radial blower is driven by efficiency and output requirements; shape and size are not significant limiting factors. In other applications where a user transports the device containing a radial blower, such as a powered air purifying respirators, the size and shape of the blower can be particularly constrained by ergonomic and transportation feasibility considerations.

There exists a need for a radial blower for use in powered air purifying respirators that can meet output and efficiency requirements while fitting within design constraints.

SUMMARY

In one aspect, the present disclosure is directed toward a powered air purifying respirator including at least a radial blower. The radial blower includes at least an impeller and a scroll having an upper outer surface and a lower outer surface. A cross section of an air passageway of the scroll includes sides corresponding to the upper outer surface and the lower outer surface, the sides having parallel slanted segments. In some exemplary embodiments, the radial blower may be disposed in a helmet.

In another aspect, the present disclosure is directed to a powered air purifying respirator including at least a radial blower. The radial blower includes at least an impeller and a scroll having an upper outer surface and a lower outer surface. A cross section of an air passageway of the scroll has a set of substantially parallel sides corresponding to the upper outer surface and the lower outer surface, wherein the set of substantially parallel sides is curved.

In yet another aspect, the present disclosure is directed toward a powered air purifying respirator including at least a radial blower. The radial blower includes at least an impeller, a scroll and an inlet. The scroll has an upper outer surface and a lower outer surface, wherein the upper outer surface is convex and the lower outer surface is concave. The inlet is disposed at the lower outer surface.

BRIEF DESCRIPTION OF THE DRAWINGS

The invention may be more completely understood in consideration of the following detailed description of various embodiments of the invention in connection with the accompanying drawings, in which.

In the following description of the illustrated embodiments, reference is made to the accompanying drawings, in which is shown by way of illustration, various embodiments in which the invention may be practiced. It is to be understood that the embodiments may be utilized and structural changes may be made without departing from the scope of the present invention. The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The present disclosure provides a powered air purifying respirator (PAPR) that includes a radial blower. The shape of the radial blower and its scroll constructed according to the present disclosure can result in more compact and ergonomic PAPR designs. In portable respirator systems, such as helmet mounted, face mounted or belt mounted PAPR designs, a radial blower as disclosed may, in some instances, decrease size and improve balance and fit of the PAPR, which can result in improved comfort for a wearer.

Figure 1:
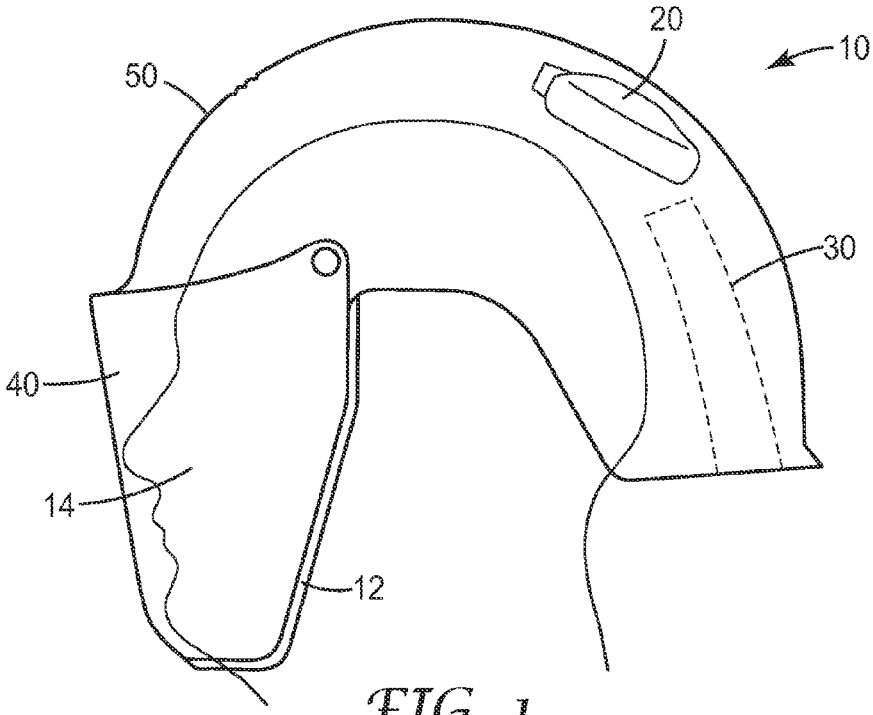
FIG. 1 shows a schematic side view of a helmet mounted powered air purifying respirator.

FIG. 1 shows a side view of a helmet mounted PAPR 10. PAPRs are generally motorized systems that use a filter to remove contaminants from ambient air before the air is delivered to the breathing zone of the wearer.

PAPR 10 includes a helmet 50 that covers a wearer's head, a visor or shield 40 that can cover and/or protect the wearer's face and contain filtered air in the area of the wearer's breathing zone 14. PAPR 10 also includes at least a filter 30 and a radial blower 20 mounted in the interior of the helmet 50. When PAPR 10 is powered, an impeller within radial blower 20 is rotated by a motor (shown in FIG. 2). In the embodiment in FIG. 1, radial blower 20 draws air that enters PAPR 10 through an inlet (not shown) through the filter 30, and into an inlet of radial blower 20. In typical embodiments of the present disclosure, the PAPR inlet is at the back of a user's head, for example, the area near the nape of a wearer's neck. An inlet to the radial blower 20 may be located at one of its sides. Preferably, the inlet is located at the side of the blower 20 that faces the user's head. Filtered air is then blown, via an outlet of the radial blower 20, into the breathing zone 14 of the wearer. Air delivery conduits of any suitable shape and size (not shown) may be provided between the inlet of the PAPR 10 and the inlet of the radial blower 20, as well as between the outlet of the radial blower 20 and the user's breathing zone 14.

Filter 30 is preferably mounted in the interior of helmet 50. However, any other suitable location is within the scope of the present disclosure, so long as the filter 30 is disposed upstream of the radial blower 20. After passing through the filter 30, air travels around an air passageway in the scroll and out the outlet of the radial blower 20 to ultimately enter the wearer's breathing zone 14. The wearer's breathing zone may be defined by the visor 40 and in some embodiments, also a face seal 12. The breathing zone 14 is preferably continually supplied with filtered air when the PAPR 10 is running.

PAPRs are frequently powered by light and mobile power sources (not shown) to allow for independent movement of a wearer. For example a PAPR may be powered by disposable or rechargeable batteries, such as Nickel Metal Hydride (NiMH), Nickel Cadmium (NiCd), Lithium Ion (LI) and Lithium Manganese Dioxide batteries or any other appropriate battery or power source.

Filter 30 can include any one or more of a variety of materials and can target a variety of substances. For example, filter 30 can include a traditional filter bed, a pleated medium, or any other type of filtering medium or combination of media. The filter medium can include a particulate filtering medium, a chemical filtering medium, or any combination of the two. A chemical filtering medium may include one or more of a sorbent, a catalyst or a chemically reactive medium and may target gases such as ammonia, methylamine, formaldehyde, chlorine, hydrogen chloride, sulfur dioxide, acidic gases, organic vapors or any other desired gas or contaminant.

Radial blower 20, as described in more detail in the context of FIGS. 2-6B below, can have a shaped profile such that the air passageway of the scroll is swept around the impeller. Traditional PAPR radial blower designs include radial blowers that have a rectangular cross-section of the scroll. In contrast, the shaped profile of the scroll according to the present disclosure can allow the blower 20 to better conform to the shape of the helmet 50 or to any other unusual shape constraints created by the particular application. In addition to allowing for a more compact construction of PAPR components, this configuration can increase clearance distance between the top of a wearer's head and the blower 20 in a helmet-mounted PAPR such as shown in FIG. 1. Such a distance can be important for meeting ANSI Z89.1, EN 397, AS-NZ 1801 Helmet Standards and other health and safety standards for hard hats. The location and mounting of a radial blower in a helmet mounted PAPR 10 can also impact the weight distribution of the PAPR 10 and can, in some instances, reduce strain on a wearer's head or neck.

Visor or shield 40 can be relatively transparent to allow a wearer good visibility and may be made of polycarbonate materials or any other suitable material. The helmet 50 can further include a sealing member or face seal 12 that makes contact with a wearer's face to provide a barrier between the filtered air within the breathing zone 14 of the wearer and the outside environment. Additionally, the positive air pressure provided by radial blower 20 can provide a supply of filtered air for the wearer. Visor or shield 40 may be molded as a single unit or may include multiple components later attached to each other, or may be constructed by any other appropriate method. While one particular construction for a PAPR is described above, any variety or configuration of PAPR can be used in accordance with the present disclosure.

Figure 2:
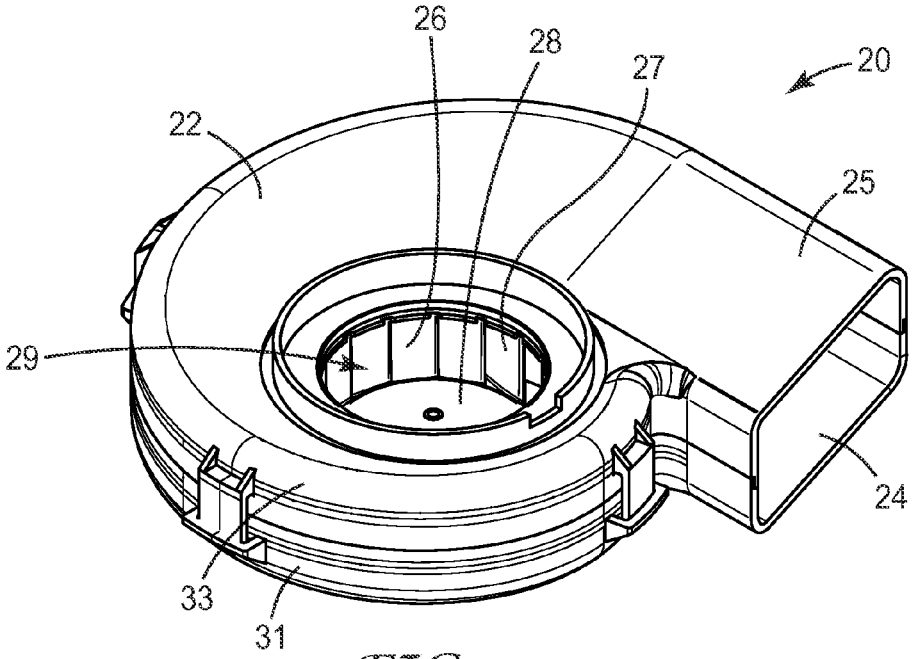
FIG. 2 shows a perspective view of a radial blower with a shaped profile.

FIG. 2 shows a perspective view of an exemplary radial blower 20 with a shaped profile. For example, the exemplary embodiment illustrated in FIG. 2 has an angled profile such that when viewed from a side perspective, at least a portion of at least one of the sides of the scroll 25 extends at an oblique angle from a center portion of the blower 20. However, other shaped profiles are also within the scope of the present disclosure. The embodiment as shown in FIG. 2 is inverted when compared to an orientation of the radial blower 20 when mounted in a helmet 50 to allow for a better view of components in radial blower 20. Generally, if the exemplary radial blower includes a generally convex side, such a side may be conveniently disposed next to a concave surface of the system intended to house it, such as the helmet 50 of the PAPR 10 shown in FIG. 1 above. On the other hand, if the exemplary radial blower includes a generally concave side, such a side may be conveniently disposed next to a convex surface, such as the head of a wearer of the PAPR 10 shown in FIG. 1 above.

Referring further to FIG. 2, the exemplary radial blower 20 includes a scroll 25. Scroll 25 provides a housing for various radial blower components in addition to providing a passageway for air drawn into and exiting radial blower 20. Scroll 25 can be made from any appropriate metal, polymeric material or any other material known in the art. Scroll 25 may be molded, cast, pressed or formed by any other appropriate manufacturing method. Scroll 25 can be a solid monolithic construction, made from two or more pieces, or any appropriate number of components. When scroll 25 is made of multiple components, the components can be attached by any appropriate means, such as adhesive or mechanical means. In the embodiment illustrated in FIG. 2, two components making up scroll 25 are secured to each other by snap-fit fasteners. Other mechanical means that could be used to secure scroll components include, for example, threaded connectors, clips or pins. In this particular embodiment, an outer lip on the first scroll component 31 and an inner lip on the second scroll component 33 overlap to provide a fluidic seal for air forced through scroll 25 by impeller 26.

Radial blower 20 also includes a motor 28. Motor 28 rotates an impeller 26 (described in more detail below) which draws air in through inlet 29 of radial blower 20. In the illustrated embodiment, inlet 29 is disposed in the center of impeller 26. Motor 28 can be housed within scroll 25 (as shown in FIG. 2) or outside scroll 25. Motor 28 can be mounted to scroll 25 by pins, screws, snap-fit fasteners or any other appropriate method or device. In the embodiment illustrated, impeller 26 is mounted in the interior of scroll 25 adjacent to motor 28. In the illustrated embodiments, impeller 26 has backward inclined blades 27, but impeller 26 may have any appropriate blade design, for example, forward curved blades, flat blades, or any other workable design. Impeller 26 can be manufactured in several different pieces that are later secured to each other, or the entire impeller 26 can be a unitary construction. For example, a base and blades of the impeller 26 may be molded as a single component and later secured to an annular construction, such as a ring, to form impeller 26. Impeller 26 can be molded or made by any other appropriate method. As air drawn through the inlet 29, it follows the curve of the air passageway 22 of scroll 25, until it eventually exits the impeller 26. The shape of the scroll air passageway 22 define a path that air exiting impeller 26 follows.

Figure 3:
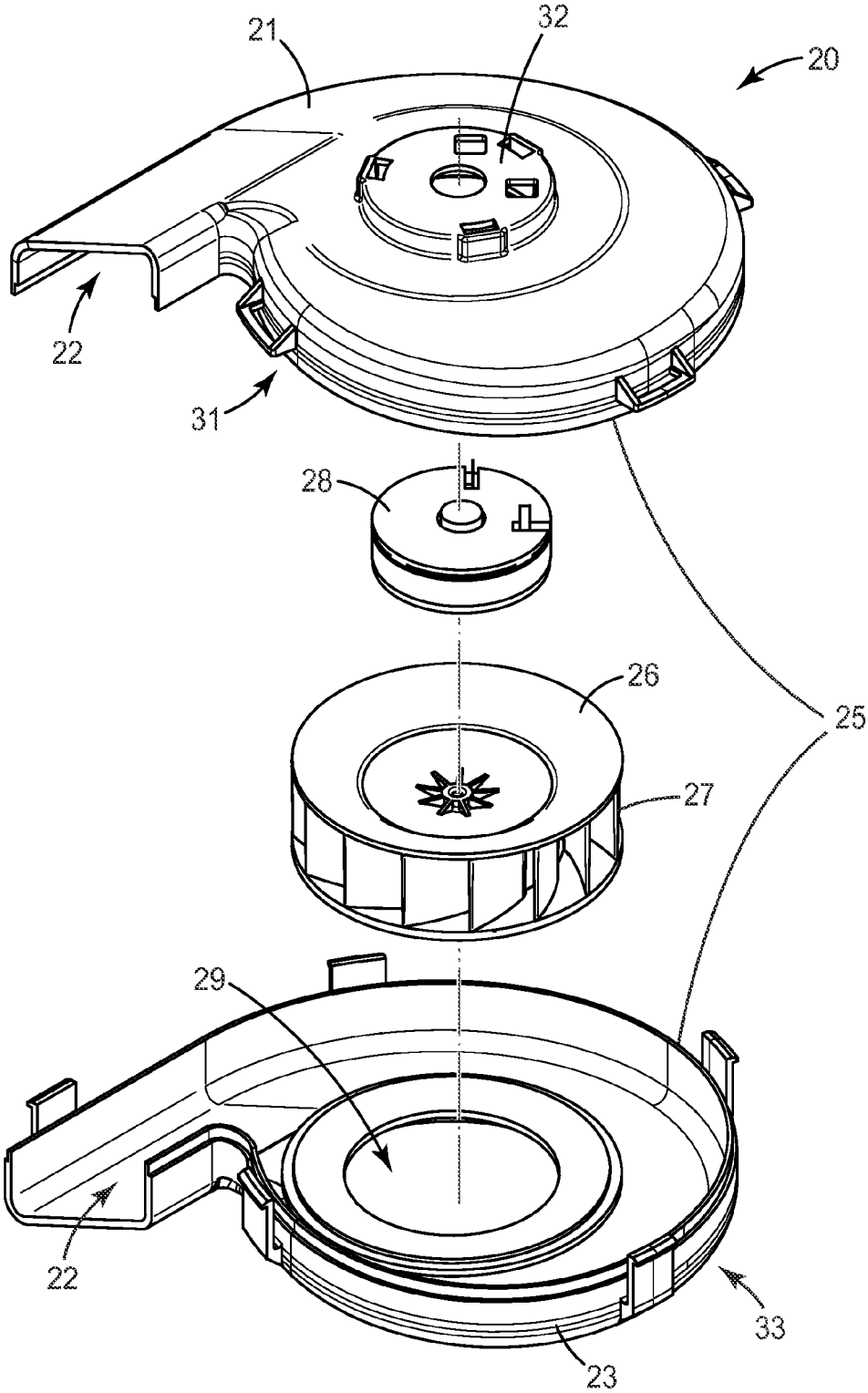
FIG. 3 shows an exploded view of a radial blower with a shaped profile.

FIG. 3 shows an exploded view of a radial blower 20 with a shaped profile. In this particular construction, scroll 25 is made of two interlocking components as discussed above with respect to FIG. 2. In this particular embodiment, motor 28 fits into a depression 32 in the interior of the first scroll component 31. Impeller 26 is mounted onto motor 28 on the side opposite first scroll component 31. Second scroll component 33 has a central opening forming inlet 29 that aligns with impeller 26 so that air is drawn through inlet 29, into the center of impeller 26 and forced outward, into air passageway 22 of scroll 25. The more complex shape of the scroll air passageway 22 allows it to maintain a cross sectional area and volume similar to a traditional scroll with a generally rectangular cross-section. At the same time, radial blower 20 may fit more efficiently within a PAPR with any curved housing, helmet, or other complex surface or size restraints.

Figure 4:
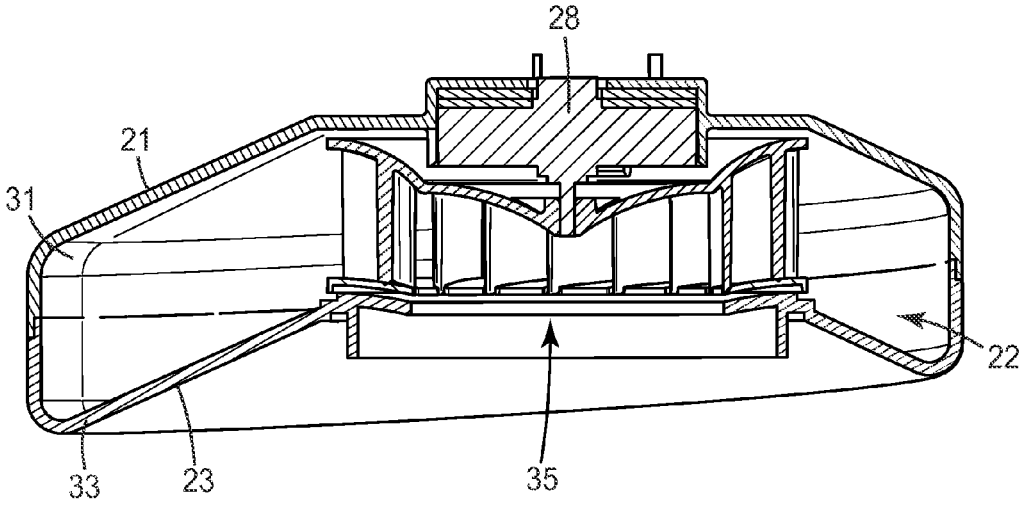
FIG. 4 shows a cross section of a radial blower with a shaped profile.

FIG. 4 shows a schematic cross section of radial blower 20. In this illustrated embodiment, outer surface 21 of first scroll component 31 is substantially convex. Convex surfaces according to the present disclosure are surfaces that curve or bulge generally outwardly. In typical embodiments, the inner surface of the first scroll component 31, which is the major surface disposed opposite the outer surface 21 and forms a part of the air passageway 22 is substantially concave. Concave surfaces according to the present disclosure are inwardly curving or hollowed surfaces. The inner surface of the first scroll component 31 may have a shape that is the opposite of the shape of the outer surface 21 (as illustrated in FIG. 4 and where the outer wall of the scroll component 31 has a uniform thickness) or it may have a different shape. With further reference to FIG. 4, an outer surface 23 of second scroll component 33 is substantially concave. Accordingly, in typical embodiments, the inner surface of the second scroll component 33, which is the major surface disposed opposite the outer surface 23 and together with the inner surface of the first scroll component forms a part of the air passageway 22, is substantially convex. The inner surface of the second scroll component 33 also may have a shape that is the opposite of the shape of the outer surface 23 or it may have a different shape.

While the precise shape of first scroll component 31 and second scroll component 33 may vary depending on features designed for mounting, accommodating the motor or other components, and other functional and cosmetic features, the overall shape of upper outer surface 21 of first scroll component 31 or lower outer surface 23 of second scroll component 33 may still be considered substantially concave or substantially convex, consistent with the present disclosure. For example, as shown in FIG. 4, the central portions of first scroll component 31 and second scroll component 33 are relatively planar to accommodate the shape of impeller 26. In this embodiment, when air is drawn by impeller 26 through inlet 29, the direction of airflow 35 into inlet 29 forms an acute angle with the direction that the lower outer surface 23 and upper outer surface 21 of scroll 22 extend in. Thus, the above-referenced convex and/or convex shapes of the scroll surfaces may be formed from planar wall segments, curved wall segments, or a combination thereof.

Figure 5:
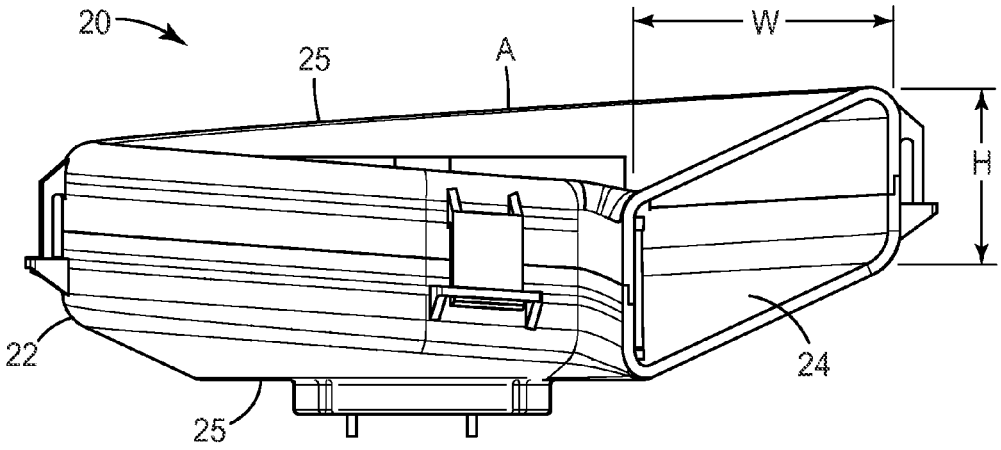
FIG. 5 is a side view of a radial blower with a shaped profile.

FIG. 5 is a side view of a radial blower 20 with an angled profile. Air passageway 22 is swept around the center of scroll 25 to create a shaped scroll 25 profile. A cross section 24 of the scroll 25 can be taken, for example, along a plane that contains the center of rotation of the impeller (e.g., as shown in FIG. 4). The scroll 25 may have a height H and width W at a given point along air passageway 22 of scroll 25. For example, an air passageway 22 height H and width W may be any suitable value, for example, about 10, 12, 15, 18, 20, 25 mm or any height in between. In this embodiment, width W of the cross-section of the air passageway 22 varies based on the radial position of the cross-section along the air passageway 22.

In some embodiments of the present disclosure, cross section 24 at the outlet may have the same height H and width W as those of a traditional radial blower, but a cross section of air passageway 22 consistent with the present disclosure forms a non-rectangular shape. For example, in the exemplary embodiment illustrated in FIG. 5 a cross section, such as the cross-section 24 at the outlet of air passageway 22 can be shaped as non-rectangular parallelogram. An exemplary non-rectangular parallelogram may have two sets of substantially parallel sides, but where none of the intersecting sides form right angles with respect to each other. Other non-rectangular shapes may have one set of substantially parallel sides and two or more non-parallel sides.

In some embodiments, at some radial positions of the cross-section on the scroll, width W can be greater than height H, and at other radial positions, height H can be greater than width W. The shape of scroll cross section and the angles of the non-rectangular shape formed in the embodiments of the present disclosure typically affect the shape of upper outer surface 21 and lower outer surface 23, such that at least one of them comprises a non-planar shape or a complex shape. A complex shape, according to the present disclosure, includes one or more surfaces created by rotating one or more slanted segments about an axis. A slanted segment may include a segment of a line, circle, ellipse, parabola or any other shape. For example, a segment of a line may be rotated about an axis with which it forms an oblique angle. A segment of an ellipse may be rotated about its major or minor axis, or may be rotated about another axis. A segment of a circle may be rotated about an axis that intersects it at its center or at any other point, or which does not intersect it. Other segments can be rotated about any appropriate axis.

Figure 6A:
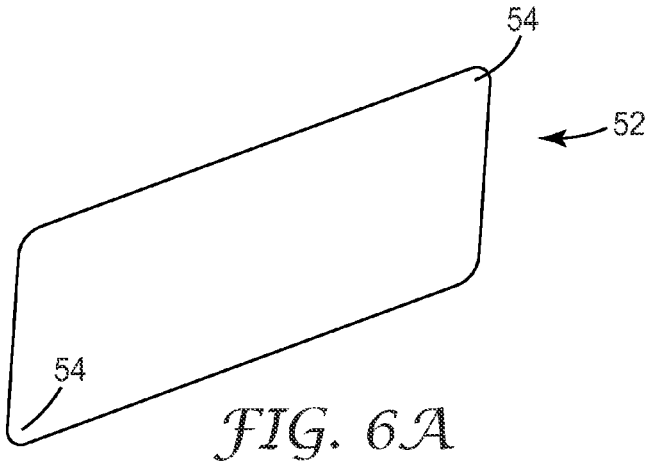
FIG. 6A is an exemplary parallelogram shaped cross section of a scroll.

FIG. 6A illustrates an exemplary non-rectangular cross-section of the air passageway according to the present disclosure, which is a generally parallelogram shaped cross section 52 of an air passageway 22 of scroll 25 taken, for example, at location A as shown in FIG. 5. In this embodiment, the cross section is shaped substantially like a parallelogram, with two sets of parallel sides. Variation from the exact shape of a parallelogram or curvature of one or more of its sides may be present in a cross section 52 consistently with the present disclosure. For example, corners of the cross section 52 are slightly curved in this particular embodiment. In this embodiment, the generally parallelogram shaped cross section 52 has two acute angles 54 formed by the adjacent intersecting sides that measure less than 90 degrees. The acute angles 54 may be any workable angles, for example, 45 degrees, 60 degrees, 65 degrees, 70 degrees, 85 degrees or any number in between.

Figure 6B:
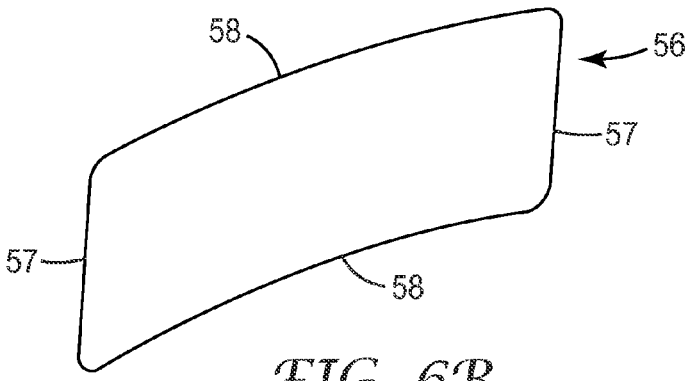
FIG. 6B is an exemplary scroll cross section with curved parallel sides.

FIG. 6B illustrates another exemplary non-rectangular cross-section of the air passageway according to the present disclosure, which is a scroll cross section 56 with one or more curved sides 58. In some embodiments, two of the curved sides 58 can be generally parallel. Curved sides 58 can have different radii of curvature, and/or can be curved such that they have similar directions of concavity or the same center of curvature. One or more curved sides 58 may have a constant or varying radius of curvature or they may include straight segments. Cross section 56 may also have a second pair of parallel sides 57. One or more sides 57 may include straight or curved sections or a combination thereof. In some embodiments, sides 57 may not be parallel.

A fan casing with a scroll cross section 52 similar to that shown in FIG. 6A may have an upper outer surface similar to a segment of an outer surface of a bowl with conically-shaped sides and a lower outer surface similar to a segment of an inner surface of a bowl with conically-shaped sides. Similarly, a fan casing with a scroll cross section 56 similar to that shown in FIG. 6B may have an upper outer surface similar to a segment of an outer surface of a rounded bowl and a lower outer surface similar to a segment of an inner surface of a rounded bowl. Or, an upper outer surface may be generally convex and a lower outer surface may be generally concave, as discussed with respect to FIG. 4.

In an alternative embodiment, a cross section of air passageway according to the present disclosure may have more than two sets of sides and may have only one set of parallel sides, or may have no parallel sides, consistent with the present disclosure.

EXAMPLE

A radial blower consistent with the present disclosure (Blower 1) was constructed. A Flat DC-Micromotor 2607T sold by Faulhaber Group of Germany was used in the blower. The motor had a diameter of 26 mm and length 7 mm and a no-load speed up to 6,600 rpm with a stall torque 7.01 mNm. The motor was disposed in a rapid prototype scroll made of ABS [acrylonitrile butadiene styrene]. The scroll had a radial width of 86.5 mm and a height of 18 mm. The outlet width was approximately 25.6 mm. A cross-section of the scroll located at the outlet formed a non-rectangular parallelogram with two acute angles of approximately 65 degrees. An impeller with backward inclined blades, a height of approximately 15 mm and a diameter of approximately 48 mm was mounted to the motor inside the scroll.

A second radial blower with a traditional design (Blower 2) was also constructed. The second blower had the same parameters as the first blower, except the scroll was flat such that a cross section of the scroll located at the outlet of the blower was rectangular.

The motor, fan and overall efficiencies of both blowers were measured at 185 LPM constant flow, as shown in Table 1.

TABLE 1

Efficiency Comparison

| | Motor Efficiency | | Fan Efficiency | | Total Efficiency | |
|---|---|---|---|---|---|---|
| Pressure | Blower 1 | Blower 2 | Blower 1 | Blower 2 | Blower 1 | Blower 2 |
| 115 | 83.0% | 79.9% | 39.1% | 38.2% | 32.5% | 30.5% |
| 130 | 82.8% | 79.8% | 39.3% | 40.1% | 32.6% | 32.0% |
| 140 | 82.5% | 79.6% | 40.2% | 41.2% | 33.2% | 32.8% |
| 150 | 82.4% | 77.9% | 40.4% | 41.5% | 33.3% | 32.4% |
| 165 | 82.0% | 78.9% | 40.8% | 42.1% | 33.5% | 33.2% |
| 175 | 81.9% | 78.7% | 41.2% | 42.6% | 33.7% | 33.6% |
| 190 | 81.6% | 78.1% | 41.3% | 43.0% | 33.7% | 33.6% |
| 210 | 81.2% | 76.9% | 41.3% | 43.2% | 33.5% | 33.2% |
| 240 | 80.3% | 77.4% | 41.5% | 42.2% | 33.3% | 32.7% |
| 265 | 79.2% | 76.5% | 41.2% | 41.2% | 32.6% | 31.5% |
| 285 | 77.4% | 75.7% | 41.2% | 40.4% | 31.9% | 30.6% |

The motor efficiency was determined by comparing the given input voltage and current with the torque and rpm at the motor shaft. The fan efficiency was measured by comparing the torque and rpm at the motor shaft with the output airflow and pressure at the outlet of the blower. The overall efficiency is determined by measuring the output airflow and pressure for a given input voltage and current. When the efficiencies for the modified blower were compared with the efficiencies for a traditional blower, very similar levels of efficiency were achieved, while the blower consistent with the present disclosure allowed for better fit within particular design constraints.

Although the present disclosure has been described with reference to preferred embodiments, those of skill in the art will recognize that changes made be made in form and detail without departing from the spirit and scope of the present disclosure.

What is claimed is:

1. A powered air purifying respirator comprising:

a helmet;

a radial blower mounted in the helmet, the radial blower including at least an impeller and a scroll having an upper outer surface and a lower outer surface, wherein the radial blower further comprises an inlet disposed at the lower outer surface of the scroll, wherein a cross section of an air passageway of the scroll includes sides corresponding to the upper outer surface and the lower outer surface, the sides having parallel slanted segments and wherein the cross section of the air passageway forms a non-rectangular parallelogram;

wherein the radial blower comprises a shaped profile with a first, generally convex side that is disposed next to a concave surface of the helmet and a second, generally concave side that is disposed next to a head of a wearer of the helmet.

2. The powered air purifying respirator of claim 1, wherein the radial blower further comprises a housing having the inlet, wherein a direction of airflow into the inlet forms an acute angle with a direction the upper outer surface and lower outer surface of the scroll extend in.

3. The powered air purifying respirator of claim 1, wherein the radial blower further comprises a motor, wherein the motor and the impeller are disposed in a center portion of the scroll.

4. The powered air purifying respirator of claim 3, wherein the upper outer surface and the lower outer surface of the scroll are planar within an outer diameter of the impeller.

5. The powered air purifying respirator of claim 1, wherein an acute angle of the parallelogram is between 45 degrees and 85 degrees.

6. The powered air purifying respirator of claim 1, wherein an acute angle of the parallelogram is between 60 degrees and 70 degrees.

7. The powered air purifying respirator of claim 1, wherein the blower further comprises an outlet, wherein a width of the outlet is greater than a height of the outlet.

8. The powered air purifying respirator of claim 1, wherein a height of the scroll along the air passageway of the scroll is constant.

9. The powered air purifying respirator of claim 1, further comprising a filter assembly, wherein the radial blower is disposed downstream of the filter assembly.

10. A powered air purifying comprising:

a helmet;

a radial blower mounted in the helmet, the radial blower including at least an impeller and a scroll having an upper outer surface and a lower outer surface, wherein the radial blower further comprises an inlet disposed at the lower outer surface of the scroll, wherein a cross section of an air passageway of the scroll has a set of substantially parallel sides corresponding to the upper outer surface and the lower outer surface, wherein the set of substantially parallel sides is curved and wherein the cross section of the air passageway forms a non-rectangular parallelogram;

wherein the radial blower comprises a shaped profile with a first, generally convex side that is disposed next to a concave surface of the helmet and a second, generally concave side that is disposed next to a head of a wearer of the helmet.

11. The powered air purifying respirator of claim 10, wherein a direction of airflow into the inlet forms an acute angle with the direction the upper outer surface and lower outer surface of the scroll extend in.

12. The powered air purifying respirator of claim 10, wherein the radial blower further comprises a motor, wherein the motor and the impeller are disposed in a center portion of the scroll.

13. The powered air purifying respirator of claim 12, wherein the upper surface and the lower surface of the scroll are planar within an outer diameter of the impeller.

14. The powered air purifying respirator of claim 10, wherein the blower further comprises an outlet, wherein a width of the outlet is greater than a height of the outlet.

15. The powered air purifying respirator of claim 10, wherein a height of the scroll along the air passageway is constant.

* * * * *

UNITED STATES PATENT AND TRADEMARK OFFICE

CERTIFICATE OF CORRECTION

PATENT NO. : 8,667,960 B2
APPLICATION NO. : 13/080772
DATED : March 11, 2014
INVENTOR(S) : David Ausen It is certified that error appears in the above-identified patent and that said Letters Patent is hereby corrected as shown below:

In the Claims

Column 8

Line 46, In Claim 10, after "purifying" insert -- respirator --.

Signed and Sealed this
Fourth Day of November, 2014

Michelle K. Lee

Michelle K. Lee
*Deputy Director of the United States Patent and Trademark Office*